United States Patent [19]

Fessler

[11] Patent Number: 4,644,729

[45] Date of Patent: Feb. 24, 1987

[54] SLAB-CUTTING MACHINE

[75] Inventor: Ewald Fessler, Heimenkirch/Allgäu, Fed. Rep. of Germany

[73] Assignee: Natec, Reich, Summer GmbH & Co., K.G., Heimenkirch/Allagu, Fed. Rep. of Germany

[21] Appl. No.: 780,277

[22] Filed: Sep. 26, 1985

Related U.S. Application Data

[62] Division of Ser. No. 537,839, Sep. 30, 1983, Pat. No. 4,583,435.

[30] Foreign Application Priority Data

Oct. 22, 1982 [DE] Fed. Rep. of Germany ..... 3239178

[51] Int. Cl.[4] ..... B26D 7/06; B65B 61/22

[52] U.S. Cl. ..... 53/157; 53/518; 83/90; 83/277; 83/417

[58] Field of Search ..... 53/157, 518, 517, 519, 53/514, 513, 415, 474; 83/90, 91, 42, 277, 278, 280, 409, 417, 355

[56] References Cited

U.S. PATENT DOCUMENTS

| | | | |
|---|---|---|---|
| 2,036,001 | 3/1936 | Walter . | |
| 2,832,388 | 4/1958 | Folk . | |
| 3,019,578 | 2/1962 | Cohen | 53/157 X |
| 3,099,304 | 7/1963 | Monsees et al. . | |
| 3,605,837 | 9/1971 | Lambert et al. . | |
| 3,959,951 | 6/1976 | Paules | 53/157 |
| 4,151,772 | 5/1979 | Johnson . | |
| 4,236,855 | 12/1980 | Wagner et al. | 53/157 X |
| 4,329,828 | 5/1982 | Wagner | 53/157 X |
| 4,405,186 | 9/1983 | Sandlberg et al. . | |
| 4,457,194 | 7/1984 | Mally | 83/42 |

FOREIGN PATENT DOCUMENTS

| | | |
|---|---|---|
| 2251567 | 5/1974 | Fed. Rep. of Germany . |
| 2252605 | 5/1974 | Fed. Rep. of Germany . |

*Primary Examiner*—James F. Coan

*Attorney, Agent, or Firm*—Fleit, Jacobson, Cohn & Price

[57] ABSTRACT

A machine for slicing slabs of cheese, sausage or the like comprises a feeding mechanism which supports the slab, feeds it intermittently at an inclination to the horizontal and includes a slab-supporting conveyor belt and gripping claws for holding the back of the slab. The conveyor belt runs over freely rotatable direction-changing rollers and on both sides of the conveyor belt parallel to the upper run thereof and displaceable above same the gripping claws are secured on parallel shafts which are provided with pivoting drives and are mounted in support members to be projectable above the upper run and retractable therefrom. The support members are provided with drives for stepwise advance with fast forward and reverse gears. A mechanism for catching the slices is disposed below the front end of the conveyor belt.

20 Claims, 8 Drawing Figures

SLAB-CUTTING MACHINE

This is a divisional of application Ser. No. 537,839 filed Sept. 30, 1983, now U.S. Pat. No. 4,583,435.

The invention relates to a machine for cutting slabs, such as of cheese, sausage or the like, comprising feeding means which support the slab, intermittently advance the slab by the thickness of the cut slices, are inclined to the horizontal and include a slab-supporting conveyor belt and claw means holding the slab at its rear end, a circular knife being mounted in an eccentric in front of the front end of the slab, which moves the relatively fast circular knife transversely to the feeding direction of the slab along its cross-sectional face.

In DE-OS No. 22 51 567, a known cheese-cutting machine of this type is stated to be disadvantageous because the thickness of the cheese slices to be cut is determined by the length of the feeding steps of the conveyor belt and because each slab of cheese has to be held on the belt by a claw pierced into the slab. When charging the machine with a new slab of cheese, the prior art states that the end of the preceding slab, which constitutes waste, must be removed from the claw, the claw must be retracted and pierced into the end of the next slab of cheese. Further, so it is stated, inaccuracies occur when feeding the slab, particularly in the case of high operating speeds, so that the thickness of the cheese slices is not always the same.

To be able to dispense with accurately setting the feeding step and yet have a high output, DE-OS No. 22 51 567 therefore suggests a cheese cutter provided with an eccentrically mounted rotated abutment disc which supports the slab of cheese at its front cut face, is disposed in front of the cutting plane of the circular knife depending on the desired slice thickness and is so driven complementary to the cutting motion of the circular knife that the margin facing the circular knife precedes it or lags behind it to a certain extent. In this known cheese-cutting machine, it is true that one can dispense with special means which intermittently feed the slab of cheese by a distance equal to the desired slice thickness. However, it is instead necessary for the slab of cheese to be supported at its front cut face by means of the abutment disc, which results in considerable friction between the rotating abutment disc and the slab and also increases the friction of the circular knife during cutting because it cannot be avoided that the abutment disc will additionally press the slice to be severed against the circular knife.

It is therefore a purpose of the invention to provide a machine of the aforementioned kind with which the slab can be sliced at a high output and with reduced friction.

According to the invention, this problem is solved in that the conveyor belt runs over freely rotatable direction-changing rollers and on both sides of the conveyor belt parallel to the upper run thereof and displaceable above same there are claw means of which the gripping claws are secured on parallel shafts which are provided with privoting drives and are mounted in support members to be projectable above the upper run and retractable therefrom, the support members being provided with drives for stepwise advance with fast forward and reverse gears, and that below the front end of the conveyor belt there are means for catching the cut slices. In the machine according to the invention, the slab obliquely supported on the conveyor belt is held by the claw means and advanced into the cutting plane by the intermittent drive of the claw means through a distance corresponding to the slice thickness. Since the claw means engage the slab directly and the slab is displaceably supported on the conveyor belt with negligibly low friction, each slice thickness very accurately corresponds to the stepwise advance. Since no pressure is exerted on the circular knife by the outer cutting face during severing of the slice, slicing takes place with the least possible friction. Severing of the slices can therefore take place at very high speed.

Since claw means with protectable and retractable gripping claws are provided on both sides of the conveyor belt, the second claw means can, during cutting of a slab, hold the following slab in a position of readiness so that, by way of the fast forward gear, the following slab can be moved to its cutting position after the gripping claws holding the end of the preceding slab have been laterally retracted from the zone of the conveyor belt. The gripping claws holding the end of the slab can now be moved as desired and, after removal of the end of the slab, receive the next slab and again hold it in a position of readiness. By reason of its tandem construction, the machine of the invention permits very high cutting outputs.

The support members of the claw means at both sides of the conveyor belt are desirably each provided at their outer sides with a nut and supported at their sides facing the conveyor belts on rails parallel thereto, the nuts being engaged with spindles which are parallel to the rails and drivable by a drive on the upper or head end of the conveyor belt. The spindle drives enable the claw means to be driven in steps or with fast motion.

According to a preferred embodiment, the support members are provided with plier-like clamping means of which the clamping jaws surround the marginal zone of the upper run of the conveyor belt and which can be coupled to the upper run thereby for travel therewith. This construction ensures that the claw means will transmit the intermittent feeding motion directly and simultaneously to the slab and the conveyor belt, which facilitates the cutting of slices of uniform thickness.

The claw means may be provided with two shafts carrying upper claws and selectively pivotable towrds a shaft which carries lower claws and turns in the opposite sense to the upper claws. In this way, slabs of different height can be simply clamped in the claw means.

In a further form of the invention, a roller track or the like pivotable in the machine frame behind the rear end of the conveyor belt, comprises a front stop abutment which can be swung in and out, and is pivotable by a piston-cylinder unit or the like into the conveying plane from a position of readiness below the conveying plane of the belt. In its position of readiness, the roller track is substantially horizontal so that the next slab to be cut can be placed on it. If, now, the roller track is moved into the conveying plane of the conveyor belt behind the first claw means after the first claw means has been displaced through a suitable distance, the rear end of the slab can be simply clamped in the gripping claws of the second claw means.

In the retracted position, the claw means are desirably disposed above the roller track swung to the substantially horizontal position of readiness so that, after the gripping claws of the claw means are opened, the residue of the slab falls onto the roller track and can be simply lifted therefrom.

Desirably, the catching means for the cut slices comprises conveyor means formed by endless belts running in parallel about rollers or cylinders. After each formation of a stack, these conveyor means can be driven to take same away or also can be driven continuously if the cut slices are to be deposited in an overlapping relationship.

According to a feature of the invention, two rake-like grids have freely projecting prongs which can be lowered between the belts from a stacking position above the upper runs of the belts. These grids serve to form stacks from the slices and, after formation of a stack of the desired height, are lowered between the belts of the conveyor means so that the stack is deposited on the conveyor means. Desirably, the grid is lowerable from the stacking position in accordance with the increasing stack height so that the slices always fall through the same height and exact stacking is ensured.

According to another feature of the invention, a paper web feeder beneath the slab conveyor belt has a substantially horizontal feeding plane disposed near the lower edge of the slab in its cutting position and intermittently pushes the free front end of a paper web over the last slice to be cut by about half the width of a slice. The front end of the paper web is disposed near the lower front edge of the slab so that, simultaneously with cutting the slices, sheets of paper are also severed from the paper web to facilitate subsequent separation of the slices.

An exact positioning of the severed sheets on the slices is facilitated by an air jet nozzle which blows the front advanced end of the paper web against the cut face of the slab.

To ensure secure retention of the slab during cutting, a pressure roller may be lowerable onto the slab in the region above the lower direction-changing roller of the slab conveyor belt.

In a feature of the invention, the roller(s) feeding the paper web are driven by gearing comprising compensating gearing of which the third input is oscillated in cutting sequence by a connecting rod from a crank drive. The stroke of the crank drive can be designed so that, after advancing the paper web and severing the sheet, the paper web is slightly retracted. This facilitates renewed feeding without problem. Desirably, the compensating gearing is compensating bevel gearing of which the housing mounting the compensating bevel gears is oscillated by the crank drive.

According to a further feature of the invention, for intermittently driving the spindles for the claw means, there is provided gearing with a clutch-brake combination in which release of the driven shaft and coupling to the intermittent drive is effected by a trapezoidal thread actuated by a crank drive and the intermittent drive is effected by a further crank drive. Desirably, the eccentricity of the crank drive for the intermittent drive is adjustable by way of planetary gear compensating gearing which radially displaces the crank shaft bearing relatively to the drive shaft of the gearing by way of a crown gear.

One example of the invention will now be described in more detail with reference to the drawing wherein.

Figure 2:
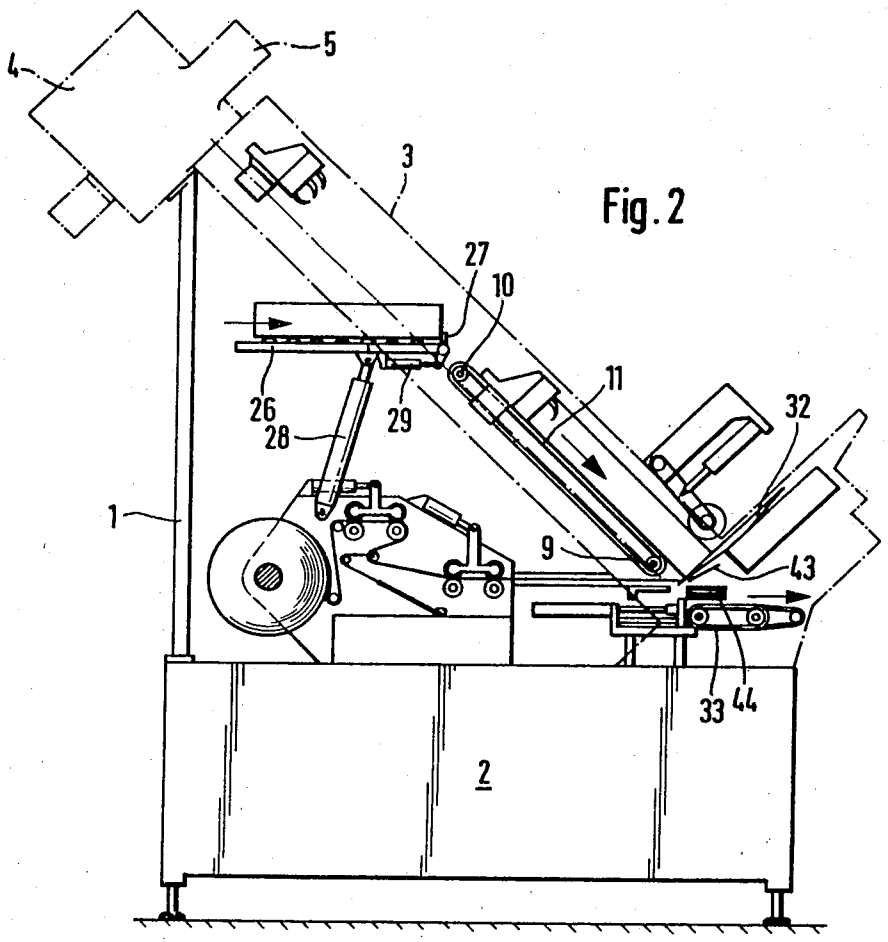
FIG. 2 is a side elevation of the cheese-cutting machine according to FIG. 1.
Figure 1:
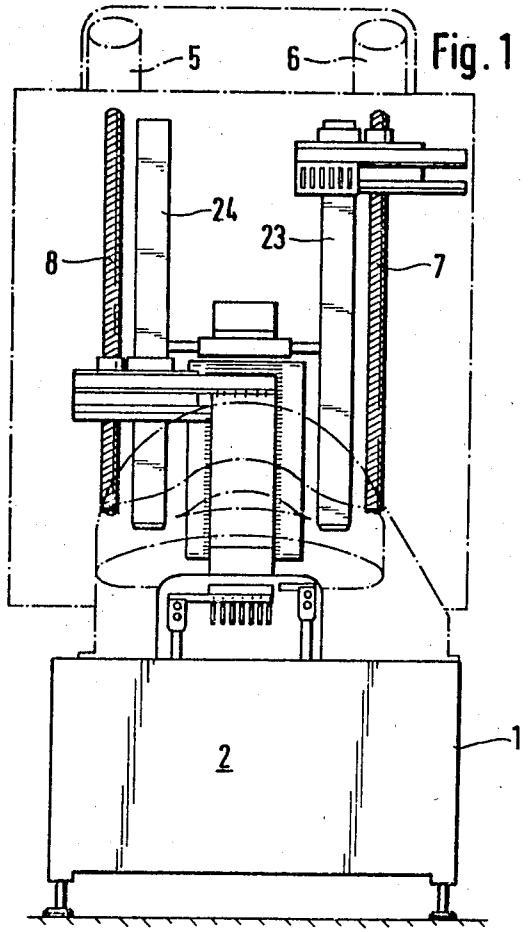
FIG. 1 is a diagrammatic front elevation of a cheese-cutting machine.

As will be seen from FIGS. 1 and 2, the cheese-cutting machine comprises a machine frame 1 which consists of a base frame member 2 and a frame-like member 3 obliquely supported thereon. The frame-like member 3 carries at its upper or head end a gear box 4 provided with flanged-on electric motors 5, 6 and containing the drive means for spaced parallel spindles 7, 8. The upper ends of the spindles 7, 8 are mounted in the gear box 4 while the lower ends of the spindles 7, 8 are mounted in a cross-member (not shown) disposed at the lower end of the frame member 3.

Figures 3, 4:
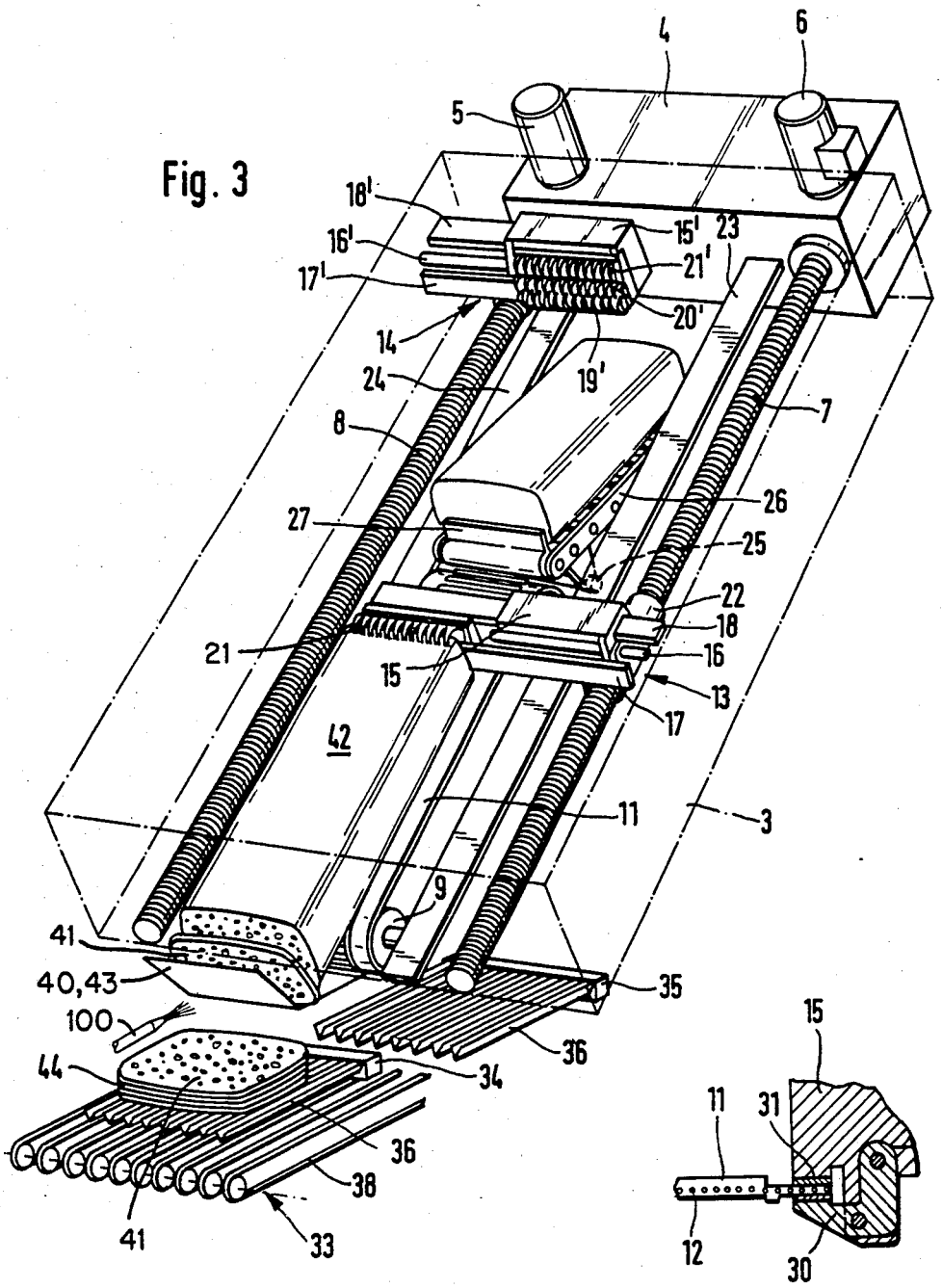
FIG. 3 is a perspective view of a transporting and retaining means of the cheese-cutting machine of FIGS. 1 and 2, the cutting means being omitted.
FIG. 4 is a section through clamping jaws clamping a claw means to a slab conveyor belt.

At the lower half of the frame member 3, rollers 9, 10 are freely rotatably mounted and an endless conveyor belt 11 which is provided with a raised portion on its outer side, runs over the rollers. The conveyor belt 11 has the raised portion only in its central zone and, as shown in FIG. 4, is reinforced with longitudinally extending steel inserts 12.

On both sides of the conveyor belt 11, claw means 13, 14 arranged in mirror image to each other comprise support members 15, 15' in which transversely displaceable gripping claw shafts 16, 16' and supporting plates 17, 18, 17', 18' are guided. Lower upwardly directed gripping claws 19 19' are secured in a comb-like manner on lower ones of the gripping claw shafts 16 and 16', respectively, whereas oppositely directed gripping claws 20, 21 and 20', 21' are arranged in a comb-like manner on two parallel superposed upper ones of the gripping claw shafts 16 and 16'', respectively. The supporting bars 17, 18, 17', 18' are driven to reciprocate by drive means (not shown). The gripping claw shafts 16, 16' also have drives (not shown) for reciprocating same as well as pivoting drives consisting of pneumatic piston-cylinder units (not shown).

Nuts 22 secured to the outer end regions of the support members 15, 15' engage with the spindles 7, 8. On both sides of the conveyor belt parallel to the spindles 7, 8 there are rails 23, 24 on which the support members 15, 15' are slidingly supported.

A roller track 26, which defines a storage conveyor, is pivotable about a shaft 25 (FIG. 3) secured in the machine frame, is disposed behind the upper direction-changing roller 10 of the conveyor belt 11. At its front end, the roller track 26 is provided with an abutment 27 which can be swung in and out. At a spacing from the pivot shaft 25, the roller track 26 is pivoted to the piston rod of a pneumatic cylinder 28 which is pivoted in the machine frame. To swing the abutment plate 27 in and out, the roller track 26 is provided with a further pneumatic cylinder 29.

As shown in FIG. 4, the support members 15, 15' have on the side facing the conveyor belt 11 a pivotable clamping jaws 30 which co-operates with a counter-bearing 31 of the support members. As soon as the support members 15, 15' have been moved into the zone of the conveyor belt 11, they are frictionally coupled to the upper run of the conveyor belt 11 by closing of the clamping jaw 30 with the aid of a pneumatic cylinder (not shown).

Beneath the operating zone of the rotating circular knife 32, which is guided over the cutting zone by an eccentric (not shown), there are conveyor means 33 comprising spaced parallel endless belts 38. Further, two grids 34, 35 are provided which have freely extending prongs 36, are moved by a mechanism (not shown), are alternately insertable in a direction parallel to themselves below the operating zone of the circular knife above the conveyor means 33, and can be lowered with their prongs in the gaps between the endless belts 38 of the conveyor means 33. The grids 34, 35 serve to from stacks 44 from cut slices 41 and are lowerable according to the increasing stack height. To take the stacks 44 away, the stacks of slices 41 are deposited on the endless belts 38 of the conveyor means 33. While one of the grids 34, 35 is taking the last stack away, the other grid can already be moved in above it so that withdrawal of the stack will not cause an interruption in the cutting operation.

Figure 5:
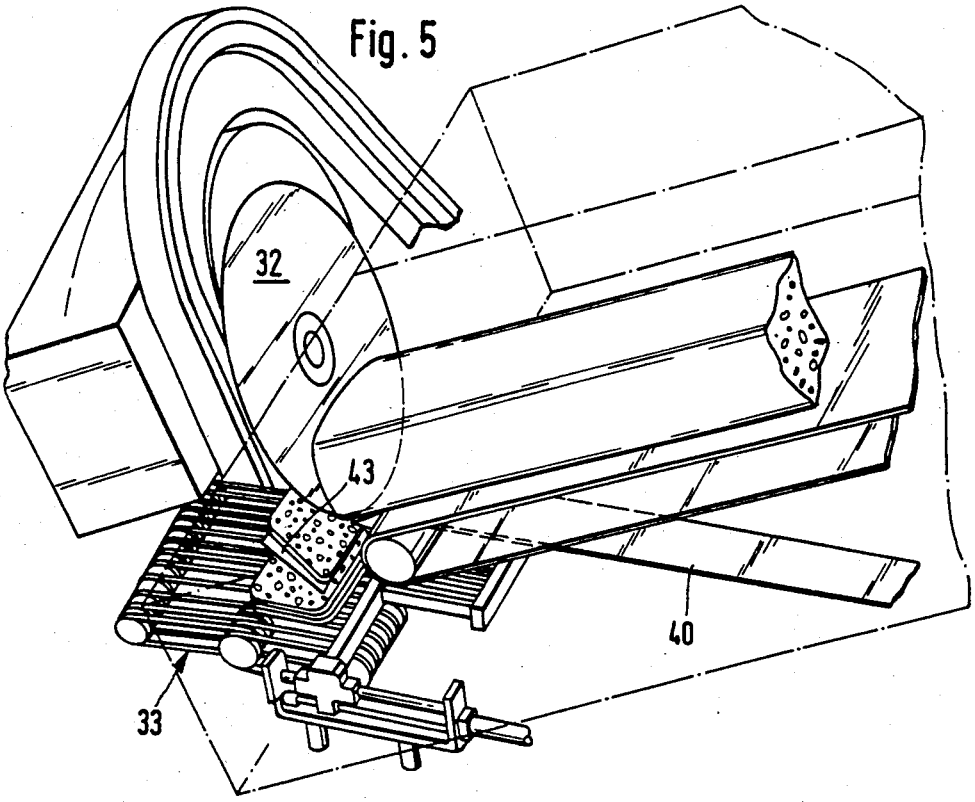
FIG. 5 is a diagrammatic perspective view of the cutting zone of the cheese-cutting machine.
Figure 6:
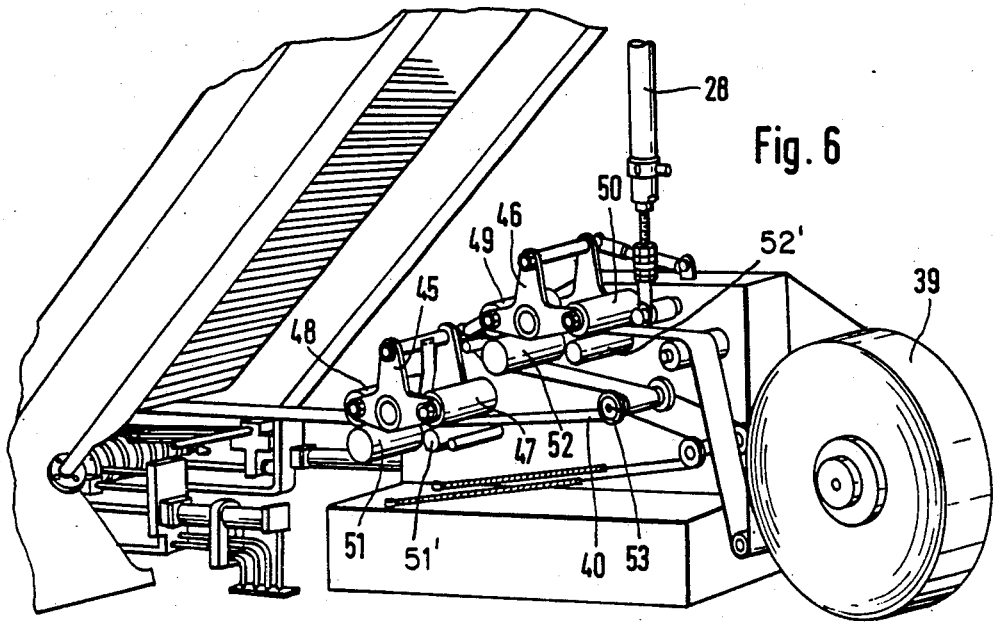
FIG. 6 is a perspective view of a paper web feeder.

As will be seen from FIG. 6, provision is made below the conveyor 11 for feeding means for a paper web 40 which is withdrawn from a storage reel 39 and is intermittently advanced over the previously cut slice 41 by a distance of about half a slice width. The paper web 40 is advanced by pairs of rollers which are mounted in rocker formation, co-operate with backing rollers and have a basic construction corresponding to that of DE-OS No. 22 52 605. The substantially horizontal feeding plane for the paper web 40 touches the slab 42 to be cut near its lower edge so that, together with the slice 41, a sheet 43 is severed from the paper web by the circular knife 32, as is clearly shown in FIG. 2, and drops onto the stack 44 together with the cut slice. More specifically, as is clearly shown in FIG. 5, the circular knife 32 makes initial cutting engagement directly with the slab 42 at a point above its lower edge and then also simultaneously cuts a sheet 43 of paper from the paper web 40.

Below the front end of the advanced paper web 40, there is a jet nozzle 100 which presses the end of the paper web in the manner shown in FIG. 3 around the lower edge of the slab 42 and against the front cut face of the last slice 41 to be severed.

The feeding means for the paper web 40 comprises pairs of pressure rollers 47, 48 and 49, 50 which are freely rotatably mounted in respective rockers 45, 46 and co-operate with backing rollers 51, 51', and 52, 52' of which the rollers 51, 52 are driven.

The feeding means with the rocker 46 serves to form a reserve loop in the paper web 40 that is extended by a spring-loaded pendulating roller 53. After lowering of the pressure roller 48, the driven roller 51 intermittently pulls the web out of this reserve loop by a distance equal to one sheet width. Pivoting of the rockers 45, 46 carrying the rollers 47–50 is effected by pneumatic cylinders in the manner known from DE-OS No. 22 52 605.

Figure 7:
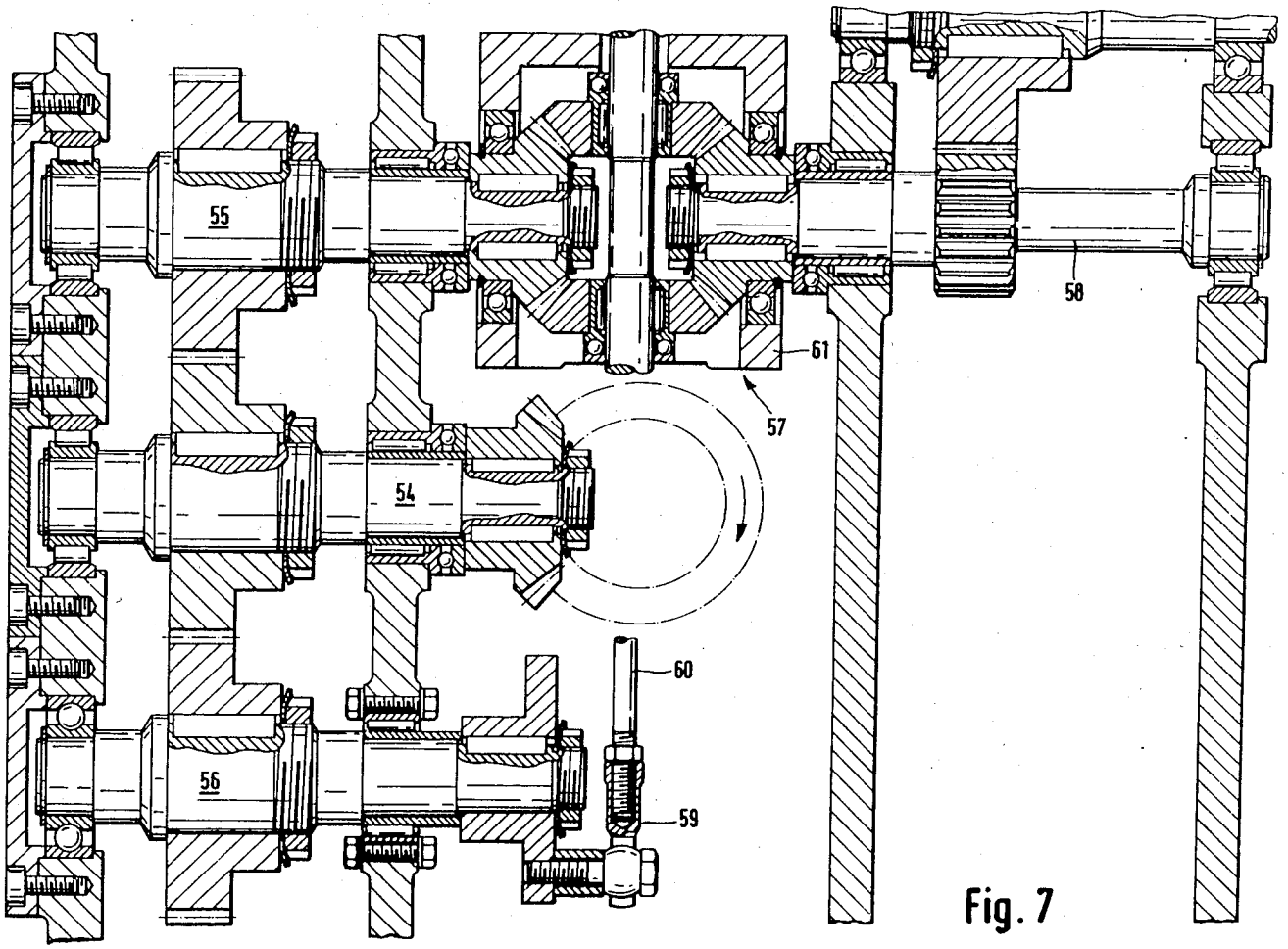
FIG. 7 is a section through paper web feeder gearing.

The gearing driving the feed roller 51 will now be described in more detail with reference to FIG. 7. By way of pairs of spur gears, the drive shaft 54 drives the shafts 55, 56 parallel thereto. The shaft 55 forms the input shaft of the bevel gear compensating gearing 57 of which the drive shaft 58 aligned therewith is operatively connected to the paper feed roller 51. The bevel gear compensating gearing 57 has a transmission ratio i=1:1.

The shaft 56 is provided with an eccentric crank pin 59 on which there is mounted the connecting rod 60 which is pivoted to the cage 61 of the bevel gear compensating gearing 57 and sets same into a pendulating to and fro motion. This pendulating movement conforms to the machine cycle by reason of the selected transmission ratios and has an amplitude corresponding to the desired intermittent feeding of the paper web.

If no paper feed is desired, the pressure roller 48 is lifted off the feed roller 51 and the paper web is clamped by the roller 47 against the roller 51'.

Figure 8:
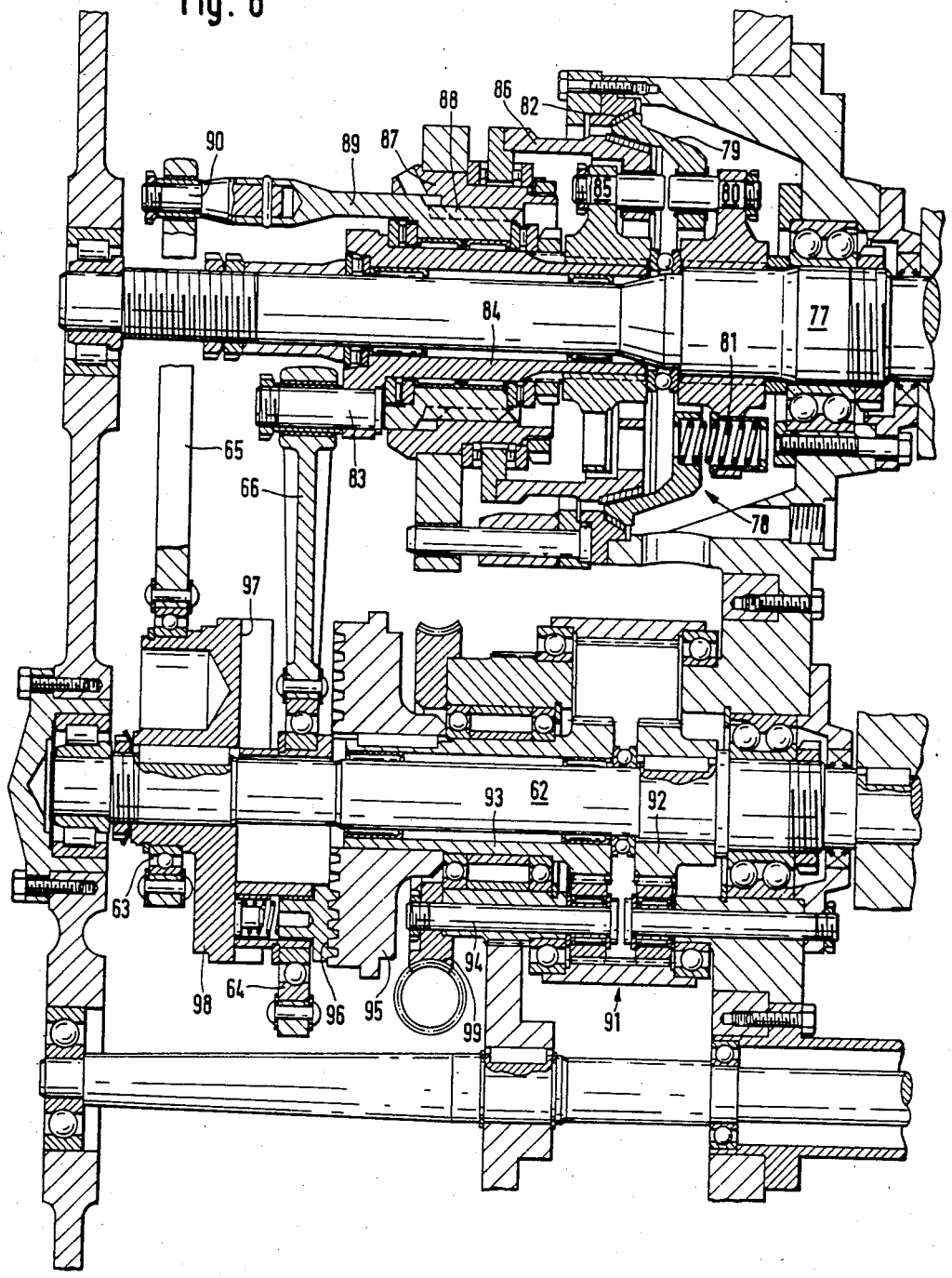
FIG. 8 is a section through feed gearing for spindles for moving respective claw means.

The gearing for the intermittent feed drive of the spindles 7, 8 will now be described in more detail with reference to FIG. 8. Two ball berings 63, 64 are eccentrically keyed onto the drive shaft 62 and, together with the connecting rods 65, 66, form respective crank driven. The drive shaft 77 which is parallel to the drive shaft 62 and operatively connected to the spindles 7, 8 is provided with a clutch-brake combination 78.

The clutch-brake combination 78 has a clutch plate 79 which is provided with an internally conical coupling surface and connected to rotate together with the driven shaft 77. The clutch plate 79 is axially displaceable relatively to the driven shaft 77 on axial entrainment bolts 80 and it is loaded by compression springs 81. In the braking position, the compression springs 81 press the conical outer ring of the clutch plate 79 against the internally conical brake ring 82 which is fixed with respect to a gear housing.

By way of the eccentric bolts 83, the connecting rod 66 oscillates the drive sleeve 84 which is rotatably mounted on the driven shaft 77. The drive sleeve 84 is provided with axially extending bolts 85 on which the coupling sleeve 86 is axially displaceable. The coupling sleeve 86 is connected to the switching sleeve 87 for free rotation but against axial displacement. The switching sleeve 87 is screwed into a triple-threaded trapezoidal screwthread 88 of the control sleeve 89 which, by way of needle bearings, is freely rotatably mounted on the drive sleeve 84 but not axially displaceable. The control sleeve 89 is provided with an eccentric bolt 90 on which the connecting rod 65 is mounted. By means of the crank drive 63, 65, the control sleeve 89 is therefore pendulated in the cycle of the machine so that the clutch plate 79 is lifted off the brake ring 82 by the coupling sleeve 86 in the cycle of the machine and coupled to the drive sleeve 84.

The stroke of the crank drive 64, 66 is variable depending on the desired intermittent feeding motion. For this purpose, the sunwheel 92 of planetary gearing 91 is keyed to the drive shaft 62. With the planetary carrier 94 stationary, it transmits the driving speed to the output sleeve 93 mounted by way of needle bearings on the drive shaft 62, so that the drive shaft 62 and the output sleeve 93 rotate at the same speed. A gear 95 having spiral trapezoidal teeth at the end is keyed on the output sleeve 93. The trapezoidal gearing engages with a serrated block 96 which is fixed to the ring carrying the ball bearing 64 and is guided in a radial guide 97 of the disc 98 keyed on the drive shaft 62. By way of a wormwheel drive 99, an additional rotary motion is introduced to the planetary carrier 94 of planetary gearing 91 so that the disc 64 is rotatable to adjust the eccentricity of the crank drive 64, 66.

The intermittent feed gearing for the spindles 7, 8 is so designed that, by way of the clutch-brake combination 78, there is transmitted during each rotation of the crank drive 64, 66 a rotational movement of 25% with sinusoidally increasing acceleration, 25% decreasing sinusoidal deceleration and a subsequent 50% standstill.

I claim:

1. A machine for cutting successive elongated articles into slices, which comprises:

cutter means for cutting slices from each of the successive elongated articles as the article is fed relative to the cutter means;

inclined feed conveyor means adjacent the cutter means for supporting each of the successive elongated articles as the article is fed relative to the cutter means;

storage conveyor means movably mounted adjacent an upper end of the inclined feed conveyor means for storing a next succeeding article in readiness for a slicing operation, the storage conveyor means being movable between a lower storage position below a conveying plane of the inclined feed conveyor means and a position in the conveying plane of the feed conveyor means for feeding the next succeeding article onto the feed conveyor means;

first and second article gripping means for gripping upper ends of respective alternate ones of the successive elongated articles to control movement of the articles on the feed and storage conveyor means;

drive means for incrementally advancing the first and second article gripping means, to advance each of the gripped articles on the inclined feed conveyor means relative to the cutter means in increments corresponding to a desired thickness of the slices to be cut from the article;

means for retracting each of the first and second article gripping means to a respective retracted position in which the article gripping means grips an upper end of the next succeeding article on the storage conveyor means after the storage conveyor means has been moved into the conveying plane of the inclined feed conveyor means;

retractable stop means adjacent a front end of the storage conveyor means for precluding feeding of the next succeeding article on the storage conveyor means onto the inclined feed conveyor means until one of the article gripping means has gripped the upper end of the article;

means for moving the storage conveyor means between its article storage position and its position in the conveying plane of the inclined feed conveyor means;

means on the storage conveyor means for moving the retractable stop means between operative and retracted positions;

means below the cutter means for catching the slices cut from the elongated articles by the cutter means; and paper feeding means adjacent a lower end of the inclined feed conveyor means for intermittently feeding a free front end portion of a paper web from a supply into a position adjacent a lower face of the elongated article on the feed conveyor means, such that as the cutter means cuts each slice from the article, the cutter means simultaneously cuts a sheet of paper from the paper web, which sheet drops with the cut slice onto the slice-catching means.

2. A machine according to claim 1, in which:

the paper web feeding means includes at least one drive roller for feeding the paper web, the drive roller being driven by gearing comprising compensating gearing which includes a third input oscillated in sequence with the article-and-paper web cutting operation by a connecting rod from an adjustable crank drive.

3. A machine according to claim 2, in which:

the compensating gearing is compensating bevel gearing which includes a cage oscillated by the crank drive.

4. A machine according claim 1, in which:

said cutter means is located to engage the article initially above a lower edge of the article; and said paper feeding means feeding the paper web below the lower end of the conveyor means adjacent the lower edge of the article and into the position adjacent the article lower face such that as the cutter means cuts each slice from the article, the cutter means makes initial cutting engagement directly with the article and then also simultaneously cuts the associated sheet of paper from the paper web.

5. A machine according to claim 4, in which said paper feeding means further comprises:

means for urging the free front end portion of the paper web around the lower edge of the article and against the lower face of the article during cutting of the article and the paper web by the cutter means.

6. A machine according to claim 5, in which:

the paper web-urging means is an air jet nozzle.

7. A machine according to claim 1, in which:

the slice-catching means includes means for collecting the cut slices and paper sheets to form a vertical stack of horizontally disposed, interleaved cut slices and paper sheets of a predetermined height.

8. A machine according to claim 7, in which:

said collecting means is vertically movable and is movable downward according to increasing stack height.

9. A machine according to claim 8, which further comprises:

conveyor means for removing successive stacks of the interleaved cut slices and paper sheets, with said collecting means being movable downward to deposit each stack on said conveyor means.

10. A machine for cutting an elongated article into slices separated by paper sheets, which comprises:

cutter means for cutting slices from the elongated articles as the article is fed relative to the cutter means;

inclined conveyor means adjacent the cutter means for supporting the elongated article as the article is fed relative to the cutter means, said cutter means being located to engage the article initially above a lower edge of the article;

article gripping means for gripping an upper end of the elongated article to control movement of the article on the conveyor means;

drive means for incrementally advancing the article gripping means, to advance the gripped article on the inclined conveyor means relative to the cutter means in increments corresponding to a desired thickness of the slices to be cut from the article;

means for retracting the article gripping means to a retracted position in which the article gripping means grips the upper end of the article;

paper feeding means adjacent a lower end of the inclined conveyor means for intermittently feeding a free front end portion of a paper web below the lower end of the conveyor means from a supply into a position adjacent a lower edge and a lower face of the elongated article, such that when the cutter means cuts a slice from the article, the cutter means makes initial cutting engagement directly with the article above the lower edge of the article and then also simultaneously cuts a sheet of paper from the paper web; and means below the cutter means for catching the article slices and the paper sheets cut from the article and the paper web, respectively, by the cutter means.

11. A machine according to claim 10, in which said paper feeding means further comprises:

means for urging the free front end portion of the paper web around the lower edge of the article and against the lower face of the article as the cutter means simultaneously cuts a slice from the article and a paper sheet from the paper web.

12. A machine according to claim 11, in which;

the paper web-urging means is an air jet nozzle.

13. A machine according to claim 10, in which:

the paper web feeding means includes at least one drive roller for feeding the paper web, the drive roller being driven by gearing comprising compensating gearing which includes a third input oscillated in sequence with the article-and-paper web cutting operation by a connecting rod from an adjustable crank drive.

14. A machine according to claim 13 in which:

the compensating gearing is compensating bevel gearing which includes a cage oscillated by the crank drive.

15. A machine according to claim 10, in which:

the slice-catching means includes means for collecting cut slices and paper sheets to form a vertical stack of horizontally disposed, interleaved cut slices and paper sheets of a predetermined height.

16. A machine according to claim 15, in which:

said collecting means is vertically movable and is movable downward according to increasing stack height.

17. A machine according to claim 16, which further comprises:

conveyor means for removing successive stacks of the interleaved cut slices and paper sheets, with said collecting means being movable downward to deposit each stack on said conveyor means.

18. A paper feeder for use with a machine for cutting elongated articles, such as slabs of cheese or sausage or the like into slices, wherein the machine comprises transporting means for supporting the elongated article to be cut and for intermittently advancing the article in steps each corresponding to the thickness of the slice previously cut, said transporting means including feed conveyor means for supporting the elongated article to be cut and means for retaining said article on the conveyor means, a knife disposed in front of a forward end of the conveyor means and connected to drive means for transversely displacing said knife to cut slices from the article, and a slice-catching means, characterized by the paper feeder comprising:

paper feeding means positionable adjacent to the forward end of the feed conveyor means for intermittently feeding a free front end portion of a paper web from a supply below the forward end of the feed conveyor means and around a lower edge of a forward face of the elongated article on the conveyor means, to a position adjacent to the forward face of the article such that as the cutter means cuts each slice from the article the cutter means makes initial cutting engagement with the article directly and then also simultaneously cuts a sheet of paper from the paper web, which sheet drops with the cut slice onto the slice-catching means.

19. A machine according to claim 18, in which:

the paper web feeding means includes at least one drive roller for feeding the paper web, the drive roller being driven by gearing comprising compensating gearing which includes a third input oscillated in sequence with the article-and-paper web cutting operation by a connecting rod from an adjustable crank drive.

20. A machine according to claim 19, in which:

the compensating gearing is compensating bevel gearing which includes a cage oscillated by the crank drive.

* * * * *